US005893352A

United States Patent [19]

Fujiwara

[11] Patent Number: 5,893,352

[45] Date of Patent: Apr. 13, 1999

[54] CYLINDER INJECTION TYPE FUEL CONTROL APPARATUS

[75] Inventor: Toru Fujiwara, Tokyo, Japan

[73] Assignee: Mitsubishi Denki Kabushiki Kaisha, Tokyo, Japan

[21] Appl. No.: 08/989,868

[22] Filed: Dec. 12, 1997

[30] Foreign Application Priority Data

Jun. 11, 1997 [JP] Japan ..... 9-153577

[51] Int. Cl.[6] ..... F02M 63/02

[52] U.S. Cl. ..... 123/479; 123/359

[58] Field of Search ..... 123/479, 359

[56] References Cited

U.S. PATENT DOCUMENTS

| | | | |
|---|---|---|---|
| 4,426,983 | 1/1984 | Seilly et al. | 123/479 |
| 4,499,876 | 2/1985 | Yamamoto | 123/479 |
| 4,546,745 | 10/1985 | Brotherston | 123/479 |
| 5,493,902 | 2/1996 | Glidewell et al. | 123/479 |
| 5,499,538 | 3/1996 | Glidewell et al. | 123/479 |

FOREIGN PATENT DOCUMENTS

| | | | |
|---|---|---|---|
| 32 47 915 | 7/1984 | Germany | 123/359 |
| 2-169834 | 6/1990 | Japan . | |

*Primary Examiner*—Erick R. Solis
*Attorney, Agent, or Firm*—Sughrue, Mion, Zinn, Macpeak & Seas, PLLC

[57] ABSTRACT

A cylinder injection type fuel control apparatus secures the operation of an internal-combustion engine even if a fuel supply system of the internal-combustion engine fails. The cylinder injection type fuel control apparatus is equipped with an injector (3) which is driven by an output signal based on a computation result of an electronic control unit (2) and which supplies fuel to the respective cylinders of the internal-combustion engine. A failure of a high-pressure fuel system is detected according to the integrated number of engine stalls that take place immediately after startup, or other means, and if a failure of the high-pressure fuel system has been detected, then the control is switched to a low-pressure fuel supply system to run the internal-combustion engine.

6 Claims, 5 Drawing Sheets

CYLINDER INJECTION TYPE FUEL CONTROL APPARATUS

BACKGROUND OF THE INVENTION

1. Field of the Invention

The present invention relates to a control apparatus of a fuel supply system which directly injects fuel into a combustion chamber, i.e. a cylinder, of a motor gasoline internal-combustion engine or the like.

2. Description of Related Art

A cylinder injection type fuel control apparatus which directly injects fuel into a combustion chamber of an internal-combustion engine is expected to provide primarily four advantages set forth below.

(1) Reduced harmful substances contained in exhaust gas

In a conventional type which injects fuel in an intake pipe, i.e. outside a cylinder, a part of the injected fuel adheres to an intake valve or the interior of the intake pipe before the injected fuel is introduced into the combustion chamber, i.e. inside the cylinder, causing a delay in the supply of the fuel into the cylinder. This makes the vaporization of the fuel difficult, frequently leading to the emission of a harmful substance (CO, HC) at the time of startup in low temperature or during a transient operation requiring a quick response.

In the case of the cylinder injection type, since fuel is directly injected into the combustion chamber, i.e. cylinder, there is no such delay in fuel supply as described above, so that highly precise air-fuel ratio control can be achieved. Thus, harmful substances contained in exhaust gas can be reduced by carrying out ideal combustion.

(2) Reduced fuel consumption

When injecting fuel into a cylinder, stratified charge combustion, wherein combustible fuel is formed around a spark plug at the time of ignition, is possible; therefore, combustion can be implemented with less fuel with respect to the amount of air introduced in the cylinder as compared with the stoichiometric ratio.

Furthermore, the successful stratified charge combustion reduces the deterioration in combustion attributable to the exhaust gas recirculation (EGR), enabling more EGR to be implemented. This feature coupled with the reduction in pumping loss permits improved fuel efficiency.

(3) Greater output

Since the combustible fuel gathers around a spark plug due to the stratified charge combustion, the end gas, which is a fuel-air mixture remaining due to the delay in combustion and which causes knocking, is decreased with resultant good anti-knocking performance. Hence, the compression ratio can be increased, leading to greater output.

Since the heat of the introduced air is removed when the fuel injected into a cylinder vaporizes, the volumetric efficiency owing to an increase in the volume density in the cylinder can be improved, leading to greater output.

(4) Improved drivability

Since fuel is directly injected into a cylinder, a total delay accumulated during the process, wherein the fuel is supplied, ignited, and burnt to produce output, is smaller as compared with the case of a conventional non-cylinder-injection type engine, thus making it possible to achieve an engine which responds more quickly to the operation performed by a driver or a request from the driver.

Hitherto, diverse inventions on direct injection type spark ignition engines have been proposed in the field of cylinder injection type fuel control apparatuses.

Japanese Unexamined Patent Publication No. 60-30420 has disclosed a cylinder direct injection type spark ignition engine adapted to advance fuel injection timing as load increases. In this engine, while the engine is running with low load, fuel is injected in the vicinity of a spark plug during the latter half of a compression stroke to form a combustible fuel-air mixture in the vicinity of the spark plug so as to ensure good ignition and combustion. While the engine is running with high load, fuel is injected in the first half of the suction stroke to fully disperse the fuel in a cylinder so as to enhance the coefficient of use of air thereby to attain greater output.

Japanese Unexamined Patent Publication No. 2-169834 has disclosed an invention on a cylinder direct injection type spark ignition engine which is capable of injecting a required amount of fuel by dividing it for the suction stroke and the compression stroke according to the operating state of the engine. More specifically, the all required injection amount of fuel is injected in the compression stroke to form a stratified fuel-air mixture which permits ignition and combustion if the required fuel injection amount is a first injection amount or less, which first injection amount being a sum of the minimum compression stroke fuel injection amount permitting the formation of an air-fuel mixture which can be ignited by a spark plug, and a minimum suction stroke fuel injection amount which enables ignition flame to propagate when the fuel evenly disperses in a cylinder. If the required fuel amount is not more than a second injection amount that is the minimum fuel injection amount which permits the formation of a homogeneous fuel-air mixture which can be ignited by a spark plug, and not less than a third injection amount that exceeds the first injection amount, then the required injection amount is injected by dividing it for the suction stroke and the compression stroke so that the fuel injected in the suction stroke forms a lean fuel-air mixture for flame propagation in the whole cylinder, while the fuel injected in the compression stroke forms a relatively rich fuel-air mixture in the vicinity of the spark plug.

FIG. 15 shows a block diagram of an internal-combustion engine disclosed in the foregoing Japanese Unexamined Patent Publication No. 2-169834. The internal-combustion engine is equipped with an engine main body 11, a surge tank 12, an air cleaner 13, an intake pipe 14 connecting the surge tank 12 and the air cleaner 13, an electrostrictive type fuel injection valve 15, a spark plug 65, a high-voltage reservoir tank 16, a high-voltage fuel pump 17 in which the discharge pressure thereof for forcibly feeding high-pressure fuel to the reservoir tank 16 via a high-pressure conduit pipe 18 can be controlled, a fuel tank 19, a low-pressure fuel pump 20 for supplying fuel from the fuel tank 19 to the high-pressure fuel pump 17 via a conduit pipe 21, a piezoelectric element cooling inlet pipe 22 for cooling the piezoelectric element of the fuel injection valve 15, a piezoelectric element cooling return pipe 23, and a branch pipe 24 for connecting the high-pressure fuel injection valve 15 to the high-pressure reservoir tank 16.

An electronic control unit 40 has ROM, RAM, and CPU which are connected using a bidirectional bus; it is provided with an input port 25 and an output port 26. The electronic control unit 40 receives a detection signal of a pressure sensor 27 which detects the pressure in the high-pressure reservoir tank 16, an output pulse of a crank angle sensor 29 which generates an output pulse that is proportional to an engine speed Ne, and an output voltage of an accelerator lift sensor 30 which is generated in accordance with a lift θA of an accelerator pedal.

The conventional cylinder injection type fuel control apparatus is configured as set forth above, and it has been posing a problem in that the internal-combustion engine fails to operate properly if the fuel supply system, especially a high-pressure fuel system including the high-pressure fuel pump 17 and the high-pressure conduit pipe 18, incurs a failure.

A cylinder injection type fuel control apparatus has been proposed which has a low-pressure fuel system and a high-pressure fuel system so as to change a low-pressure control mode over to a high pressure control mode upon completion of startup; however, it has been posing a problem in that, if the pressure of fuel fails to reach a high level in the high pressure control mode following the startup, e.g., if a fuel system including the high-pressure fuel pump and a fuel pressure switching solenoid fails, then the valve opening time will be too short for the fuel pressure and an inadequate amount of fuel is supplied, preventing the drive because the engine fails to work properly.

SUMMARY OF THE INVENTION

The present invention has been made with a view toward solving the problems described above, and it is an object of the invention to provide a cylinder injection type fuel control apparatus which is capable of preventing an engine from failing to operate or run even when a high-pressure fuel supply system has incurred a failure.

The present invention is designed so that if it is found that the fuel pressure has not reached a high level after startup and a failure of a fuel supply system is found, then a normal low-pressure supply side is used to forcibly retain a low pressure control mode even after the startup so as to secure the operation of an engine. A failure detecting means employs a method wherein it is determined that fuel has not been maintained at high pressure if a predetermined number of engine stalls have been repeated during a predetermined period of time after startup, and a method wherein a pressure sensor installed on the downstream side from the discharge side of a high-pressure fuel pump is used to detect the failure.

To this end, according to one aspect of the present invention, there is provided a cylinder injection type fuel control apparatus equipped with: an electronic control unit which computes the amount of fuel to be supplied to an internal-combustion engine according to the amount of intake air or a parameter corresponding thereto or various types of information of the internal-combustion engine such as engine speed; an injector which is driven according to an output signal based on the computation result given by the electronic control unit and which supplies fuel to each cylinder of the internal-combustion engine; and a high-pressure fuel supply system which supplies the fuel to the injector; wherein control mode is switched to a low-pressure fuel control mode, in which the fuel pressure is low, to run the internal-combustion engine if it is determined, according to various types of information of the internal-combustion engine, that the high-pressure fuel supply system has failed.

According to another aspect of the present invention, there is provided a cylinder injection type fuel control apparatus equipped with: an electronic control unit which computes the amount of fuel to be supplied to an internal-combustion engine according to the amount of intake air or a parameter corresponding thereto or various types of information of the internal-combustion engine such as engine speed; an injector which is driven according to an output signal based on the computation result given by the electronic control unit and which supplies fuel to each cylinder of the internal-combustion engine; a low-pressure fuel supply system which supplies the fuel to the injector at the time of startup or the like; a high-pressure fuel supply system which supplies the fuel to the injector; and means for switching between the low-pressure fuel supply system and the high-pressure fuel supply system; wherein control is switched over to the low-pressure fuel supply system to run the internal-combustion engine if it is determined, according to various types of information of the internal-combustion engine, that the high-pressure fuel supply system has failed.

In a preferred form of the present invention, a failure of the high-pressure fuel system is determined according to the integrated number of engine stalls immediately after the startup of the internal-combustion engine.

In another preferred form of the present invention, a failure of the high-pressure fuel system is detected by means of a signal issued by a fuel pressure sensor provided in the high-pressure fuel system.

DESCRIPTION OF THE PREFERRED EMBODIMENTS

First Embodiment

Figure 1:
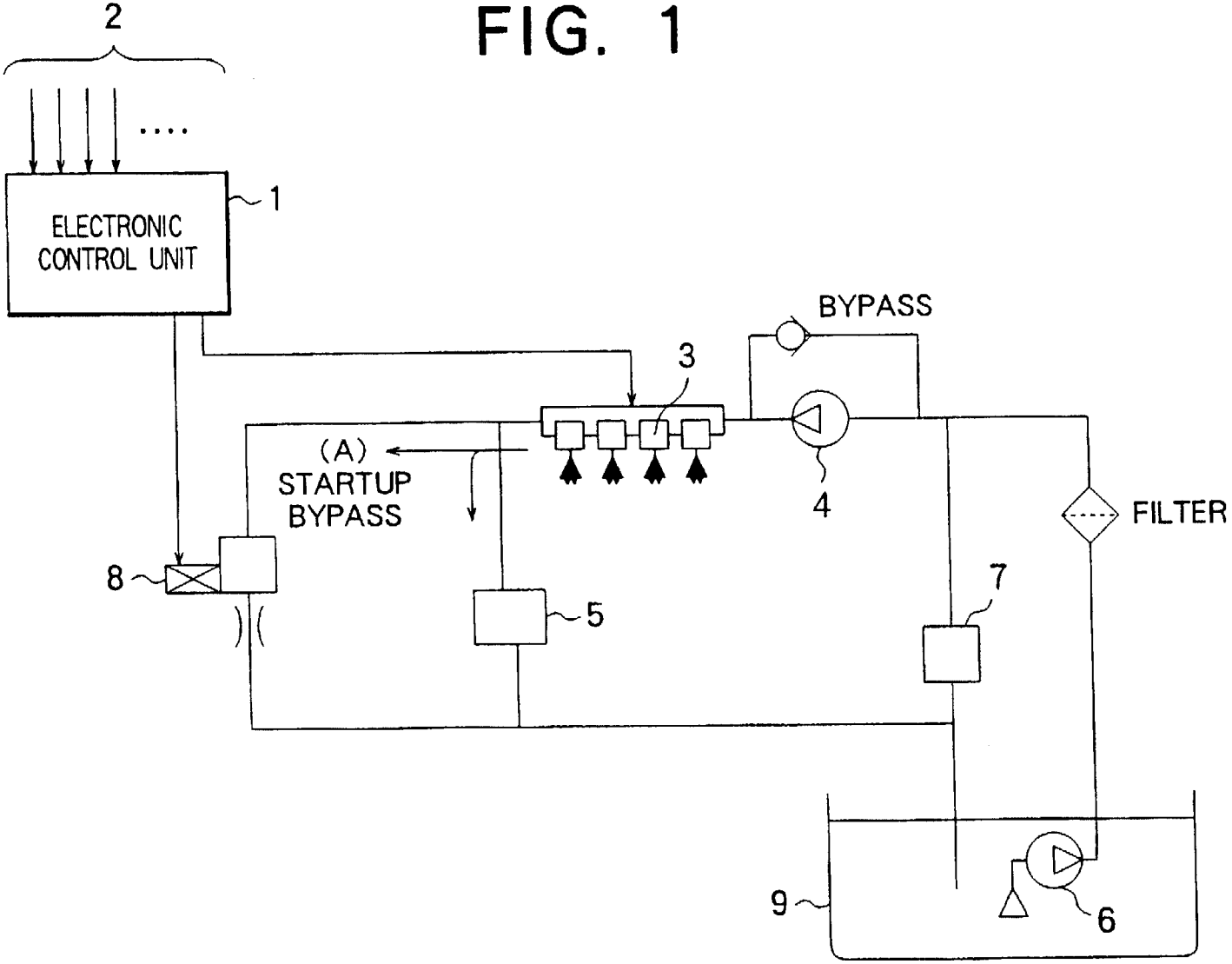
FIG. 1 is a block diagram showing a cylinder injection type fuel control apparatus to which the present invention applied.

The schematic configuration of a cylinder injection type fuel control apparatus to which the present invention is applied will be first described in conjunction with FIG. 1. In the drawing, an electronic control unit 1 is a digital computer constituted primarily by a ROM, a RAM, and a CPU which are interconnected by a bidirectional bus; it is equipped with an input port for receiving signals from various sensors and an output port for driving various elements to be controlled. The electronic control unit 1 computes the amount of fuel to be supplied according to the amount of intake air of the engine or a parameter corresponding thereto or diverse types of information 2 including engine speed, the angular position of a crank, and the signals of $O_2$ sensor. An injector 3 which supplies fuel by injecting it to the respective cylinders of the engine is driven by a signal issued according to the computation result supplied by the electronic control unit 1. A high-pressure fuel pump 4 forcibly feeds fuel, which has been pressurized to have high pressure, to the injector 3. A high-pressure regulator 5 adjusts the pressure of the fuel discharged from the high-pressure fuel pump 4. The fuel pump 6 supplies the fuel in a fuel tank 9 to the high-pressure fuel pump 4 via a filter. The fuel control apparatus is further provided with a low-pressure regulator 7 for adjusting the pressure of the fuel supplied to the high-pressure fuel pump 4 and a fuel pressure switching solenoid 8 for switching the fuel passage in order to bypass (A) the high-pressure regulator 5; wherein the high-pressure fuel pump 4 is driven by the engine and the fuel pump 6 is electrically driven.

A typical fuel control procedure implemented by the cylinder injection type fuel control apparatus in accordance with the present invention shown in FIG. 1 will now be described.

Low Pressure Control Mode

To start up the engine, the electronic control unit 1 drives the injector 3 by determining the startup condition by using the diverse types of information 2 of the engine. At this point, the high-pressure fuel pump 4 driven by the engine is not yet ready to carry out pressurization; hence, it actuates the fuel pressure switching solenoid 8 to change the fuel passage over to the bypass passage (A). Thus, the low-pressure fuel with its pressure regulated by the low-pressure regulator 7 is supplied to the injector 3 by the fuel pump 6 driven electrically via the bypass passage. In this case, the amount of fuel supplied to a cylinder, namely, a combustion chamber, is determined by the pressure of the fuel and the time during which the valve of the injector 3 is held opened; therefore, the electronic control unit 1 supplies to the injector 3 a drive signal which holds the valve of the injector 3 open for the period of time that matches the pressure, namely, the low pressure, of the fuel. The drive timing is adjusted so that the fuel is injected during the suction stroke of the engine, wherein the cylinder pressure is low, to match the low fuel pressure and that a combustible material mixed with intake air is ignited in the following compression stroke.

High Pressure Control Mode

Then, the electronic control unit 1 detects the completion of the startup by the diverse types of information 2 of the engine, and switches the subsequent control mode from the low pressure control mode to the high pressure control mode. In the high pressure control mode, the fuel pressure switching solenoid 8 is actuated to switch the fuel supply passage from the startup bypass (A) to a high-pressure regulator side (B) so as to supply the high-pressure fuel, which has been obtained by pressurizing the fuel from the fuel pump 6, to the injector 3 from the high-pressure fuel pump 4. This high fuel pressure is utilized to drive the injector 3 in the compression stroke of the engine in order to inject the fuel into the combustion chamber, thereby performing the stratified charge combustion. The time during which the valve of the injector 3 is held open in the high pressure control mode shortens because the fuel pressure is higher than that in the low pressure control mode.

In the foregoing fuel control, the low pressure control mode is changed over to the high pressure control mode at the completion of the startup. This poses a problem in that, if the pressure of the fuel fails to rise to high level in the high pressure control mode following the startup, e.g. if the fuel system including the high-pressure fuel pump and the fuel pressure switching solenoid fails, then the time during which the valve is held open is too short for the fuel pressure, and an insufficient amount of fuel is supplied, preventing proper operation or running of the engine.

To solve the problem described above, according to the present invention, if the fuel pressure fails to reach the high level after the startup, then the electronic control unit detects it and determines that the fuel supply system has failed. If this happens, then the normal low-pressure supply side is used to forcibly retain the low pressure control mode even after the startup so as to ensure the operation of the engine.

The first embodiment employs, as the means for detecting a failure of the fuel supply system, a method wherein it is determined that the fuel has not been maintained at the high level if a predetermined number of engine stalls have been repeated during a predetermined period of time after the startup.

The control procedure for the fuel supply system according the first embodiment will now be described in conjunction with the control flowchart of the electronic control unit 1 shown in FIG. 2.

In step S101, the electronic control unit 1 first detects that the power of the engine has been turned ON, then in step S102, it detects the startup of the engine according to the diverse types of information 2, drives the fuel pressure switching solenoid 8 in step S103 to switch the fuel passage to the startup bypass side (A), and controls the fuel supply system of the engine in the low pressure control mode in step S104. The operation in the low pressure control mode is as previously described.

In step S105, the electronic control unit 1 determines whether the startup has been completed, according to the diverse types of information 2, then releases the fuel pressure switching solenoid 8 in step S106 to supply fuel to the high-pressure fuel pump 4 thereby to shift to the high pressure control mode in step S107. The operation in the high pressure control mode is as previously described.

After moving to the high pressure control mode, if the engine is running stably, i.e. if no engine stall problem takes place, then the high pressure control mode is maintained and the stratified charge combustion is accordingly retained in steps S107 and S108. No particular description will be given to the various types of detection and determination based on the diverse types of information 2 because they are publicly known. It should be noted that the aforesaid control flow is a standard one.

In the first embodiment, after the shift to the high pressure control mode in step S107, the electronic control unit 1 determines in step S108 whether the engine stall problem has occurred, and if it determines that no engine stall problem has taken place, then it continues the high pressure control mode in step S107; or if it determines that the engine stall problem has arisen, then it determines in step S201 whether a predetermined period of time has passed since it determined the startup in step S105. The predetermined elapsed time in step S201 is set to a value which makes it possible to discriminate an engine stall caused by a failure of the fuel system from a regular engine stall. This discrimination is possible by utilizing a behavior as set forth below, for example: if a driver has failed to start up the engine, an engine stall happens shortly after the determination of the startup, whereas if a failure of the fuel system has occurred, the engine stall happens after a relatively longer time passes since the startup determination was performed. If the electronic control unit 1 decides in step S201 that the engine stall problem has taken place when the predetermined time has passed following the startup, then it adds 1 to a number $N_S$ of engine stalls in step S202; or if it decides that the engine stall is the one that happens before the predetermined time elapses, then it resets the number $N_S$ of engine stalls to zero ($N_S$=0) in step S203. In steps S202 and S203, the continuity of engine stalls is computed. The continuity number $N_S$ of engine stalls is set to a value which enhances the detection accuracy by utilizing the characteristics of a failure of the fuel system so as to discriminate the continuous engine stalls from the transitory regular startup failures.

Normally, the driver repeats the startup operation if an engine stall happens; hence, the electronic control unit 1 goes back to step S102 and conducts the control for the startup in the low pressure control mode in step S104. In step S204, the electronic control unit 1 determines whether the number $N_S$ of engine stalls has exceeded the predetermined value, and if the determination result is negative, then it goes back to the aforesaid standard control sequence, or if the determination result is affirmative, then it proceeds to step S205 wherein it continues the operation in the low pressure control mode.

Second Embodiment

In the first embodiment, the failures of the fuel supply system are detected in such a manner that, if the predetermined number of engine stalls take place during the predetermined period of time following the startup of the engine, it is determined that the fuel has not been maintained at the high level. In a second embodiment, the failures of the fuel supply system are detected by a pressure sensor which is installed on the downstream side of the discharge port of the high-pressure fuel pump and which detects the pressure of fuel.

Figure 2:
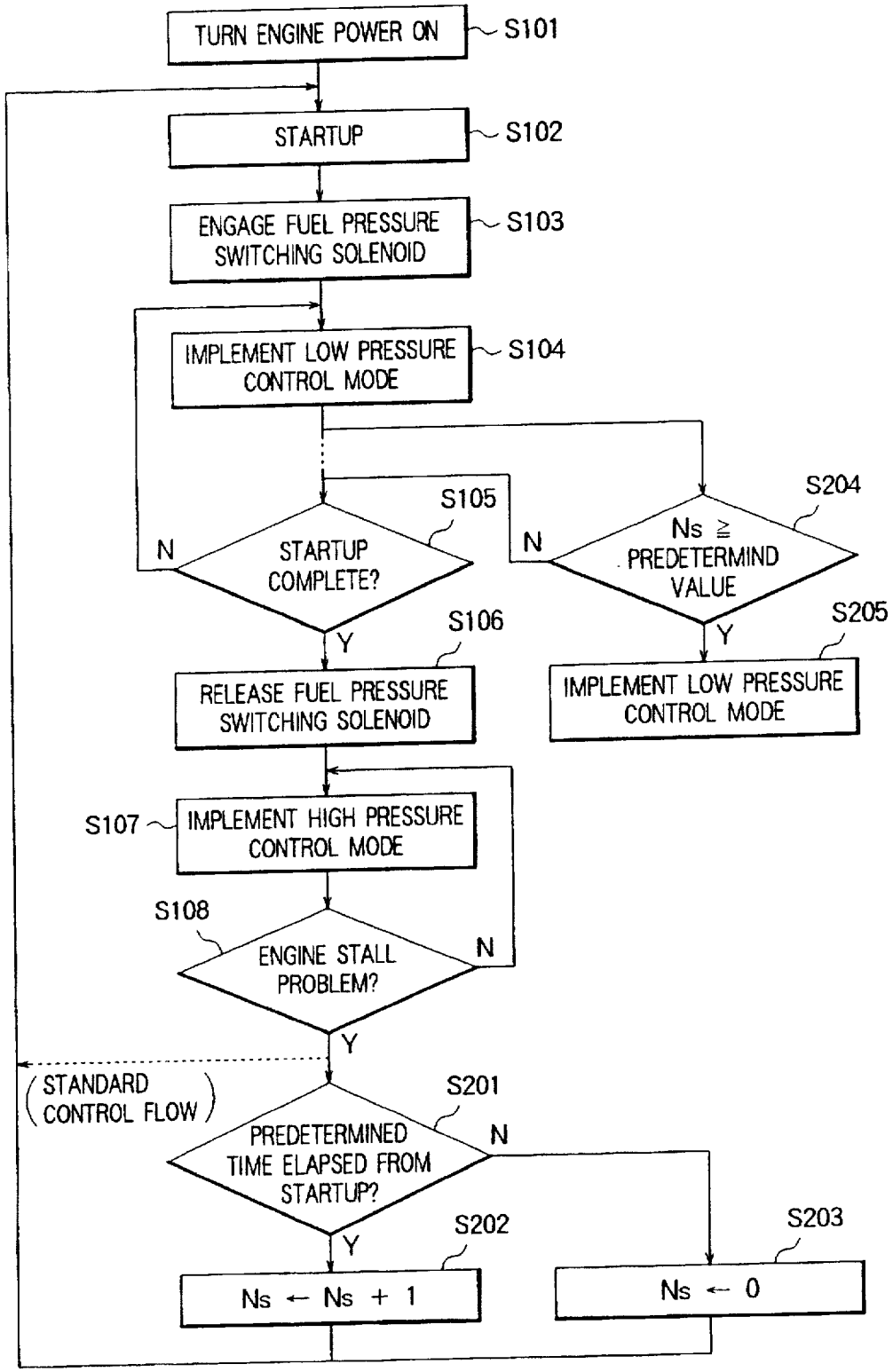
FIG. 2 is a flowchart illustrating a control routine implemented by a fuel supply system according to a first embodiment.
Figure 3:
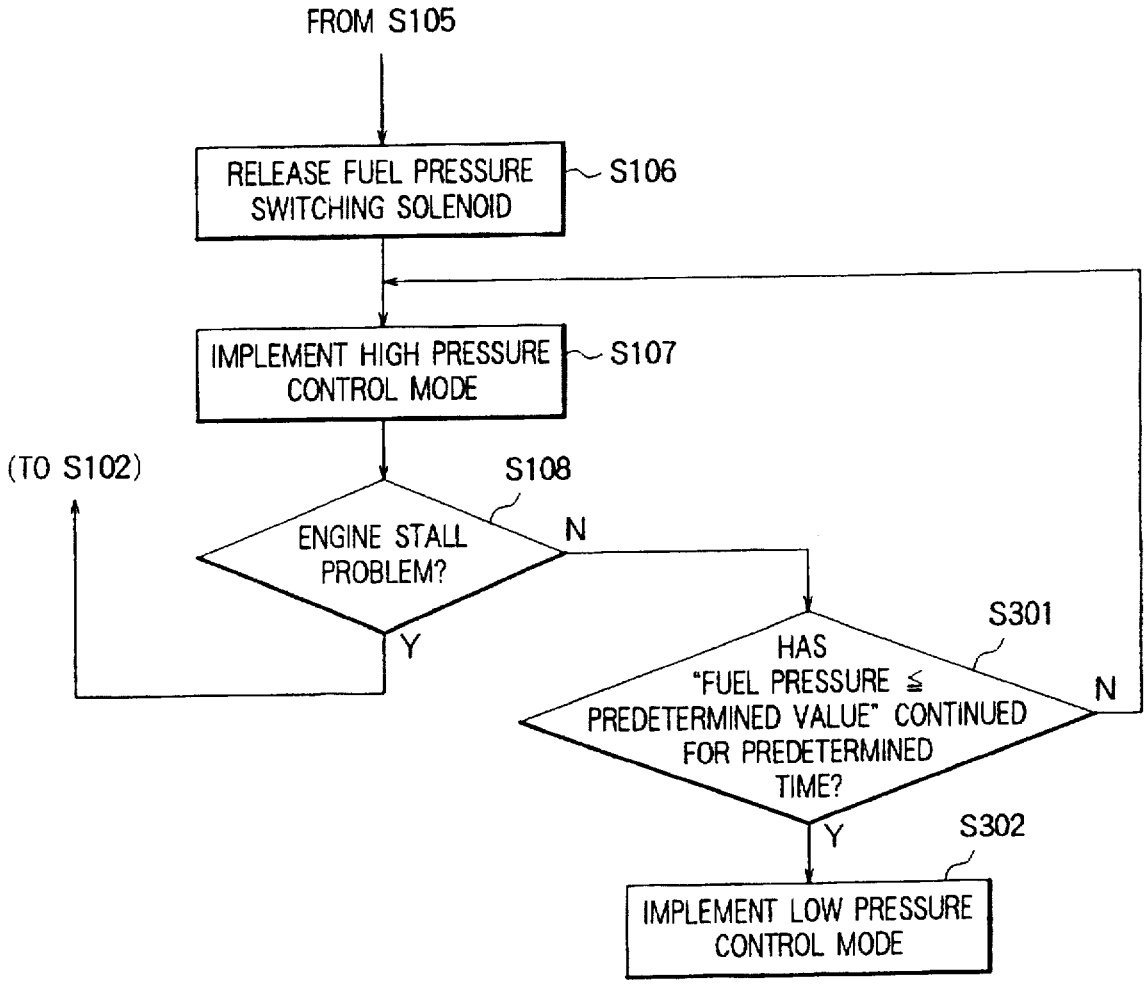
FIG. 3 is a flowchart illustrating a part of a control routine implemented by a fuel supply system according to a second embodiment.

FIG. 3 shows a control flowchart of the fuel supply system according to the second embodiment; steps S101 through S108 in FIG. 3 are basically the same as those of the fuel control, namely, the standard control, shown in FIG. 2.

In the second embodiment, while the control is being conducted in the high pressure control mode in step S107, the electronic control unit determines in step S108 whether the engine stall problem has arisen, and if the determination result is negative, then it further determines in step S301 whether the reading on the pressure sensor, not shown, which is installed on the downstream side from the discharge port of the high-pressure fuel pump 4 and which detects the pressure of fuel, is a predetermined value or less, and if it determines that the reading is the predetermined value or more, then it continues the high pressure control mode of step S107; or if it decides in step S301 that the reading stays less than the predetermined value for a predetermined period of time, then it determines that the fuel system has failed and switches the control mode to the low pressure control mode in step S302.

Third Embodiment

Figure 4:
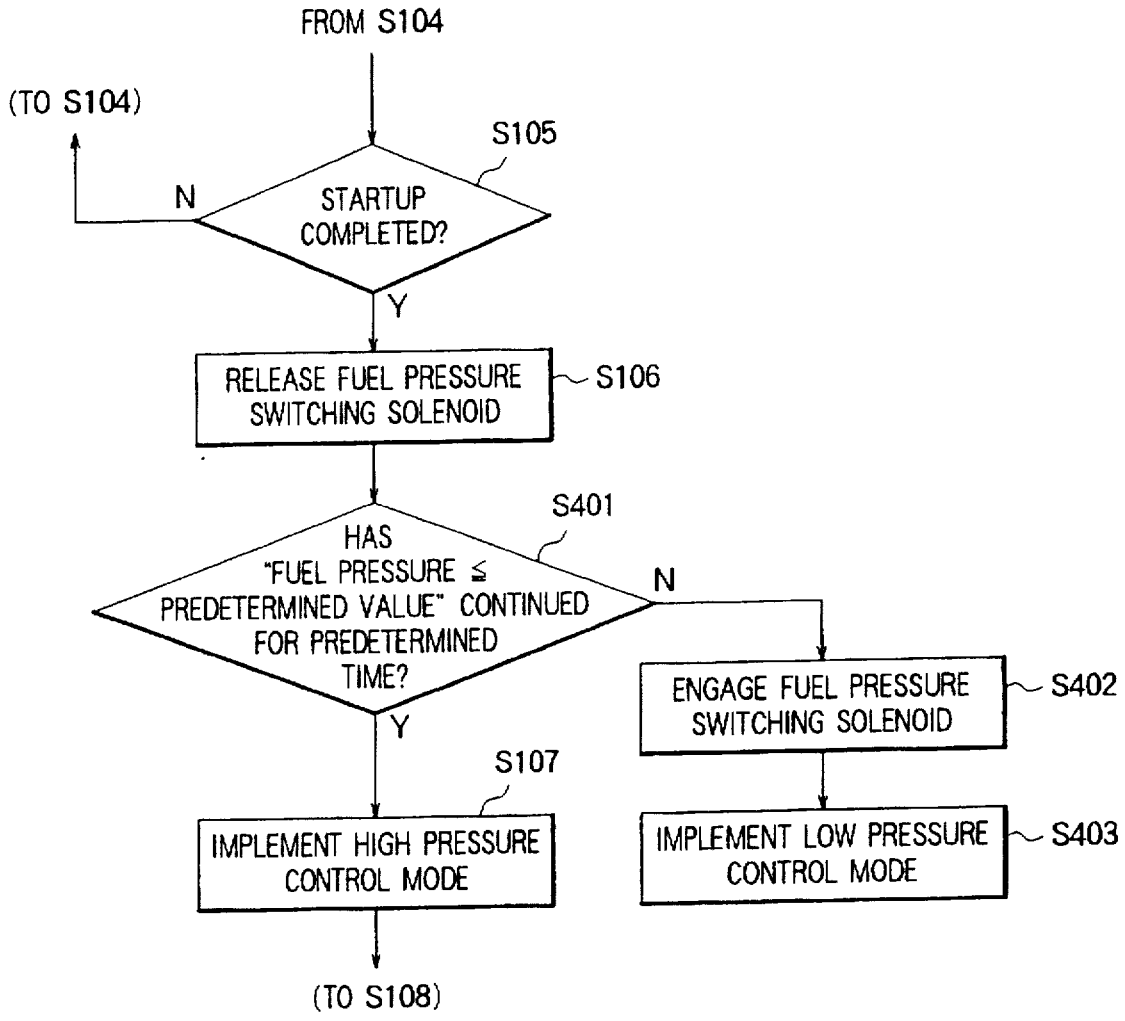
FIG. 4 is a flowchart illustrating a part of a control routine implemented by a fuel supply system according to a third embodiment.
Figure 5:
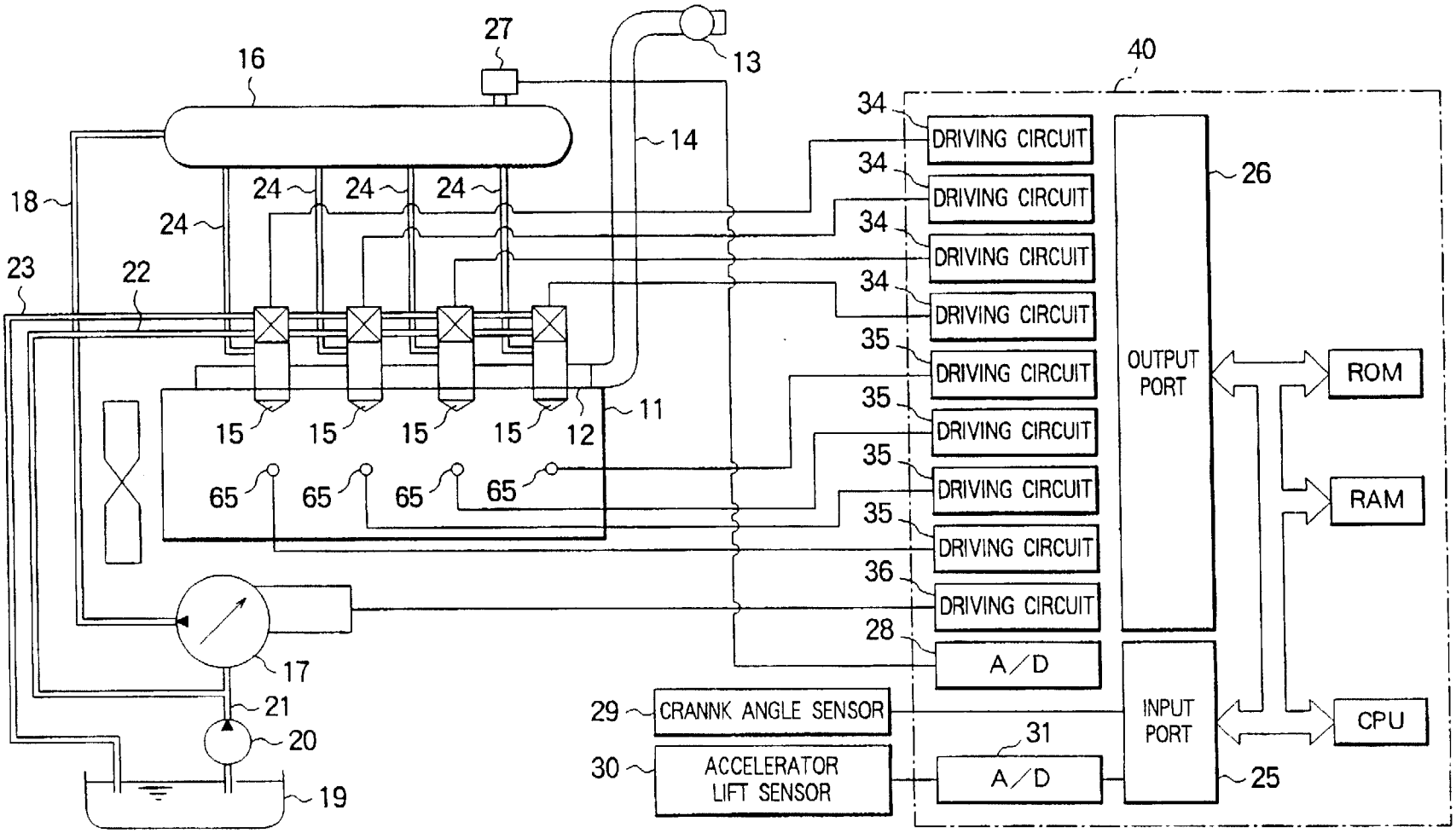
FIG. 5 PRIOR ART
FIG. 5 is a block diagram showing a conventional cylinder injection type fuel control apparatus.

A third embodiment is an example of the control sequence implemented when the fuel system fails in a normal operation state after the engine is started up. The procedure for determining a failure of the fuel system immediately following the startup will be described with reference to FIG. 4. The operation flow from steps S101 through S108 shown in FIG. 4 is the same as that of the standard control flow of the first embodiment.

After detecting in step S105 the completion of the startup, the electronic control unit releases the fuel pressure switching solenoid 8 in step S106 to close the fuel bypass passage. Then, in step S401, the electronic control unit determines whether the reading on the pressure sensor (not shown) which is provided on the downstream side from the discharge port of the high-pressure fuel pump 4 is a predetermined value or less; if it decides that the reading is the predetermined value or more, then it engages the high pressure control mode in step S107 as usual, whereas if it decides that the fuel pressure detected in step S401 is lower than the predetermined value, then it decides that the fuel system has failed and it drives the fuel pressure switching solenoid 8 to switch back to the bypass passage (A) in step S402 to carry out control in the low pressure control mode in step S403.

What is claimed is:

1. A cylinder injection type fuel control apparatus comprising:

an electronic control unit which computes the amount of fuel to be supplied to an internal-combustion engine according to input parameters corresponding to operational conditions of said internal-combustion engine;

an injector which is driven according to an output signal based on a computation result given by said electronic control unit and which supplies fuel to each cylinder of said internal-combustion engine; and a high-pressure fuel supply system which supplies said fuel to said injector; wherein the control apparatus can be switched between a high pressure control mode and a low pressure control mode, and wherein the control apparatus is switched to a low pressure control mode, in which the fuel pressure is maintained at a low level, to run said internal-combustion engine when it is determined, according to various types of information of said internal-combustion engine, that said high-pressure fuel supply system has failed.

2. A cylinder injection type fuel control apparatus comprising:

an electronic control unit which computes the amount of fuel to be supplied to an internal-combustion engine according to input parameters corresponding to operational conditions of said internal-combustion engine;

an injector which is driven according to an output signal based on a computation result given by said electronic control unit and which supplies fuel to each cylinder of said internal-combustion engine;

a low-pressure fuel supply system which supplies said fuel to said injector at the time of startup or the like;

a high-pressure fuel supply system which supplies said fuel to said injector; and means for switching between said low-pressure fuel supply system and said high-pressure fuel supply system;

wherein control is switched over to said low-pressure fuel supply system to run said internal-combustion engine when it is determined, according to various types of information of said internal-combustion engine, that said high-pressure fuel supply system has failed.

3. The cylinder injection type fuel control apparatus according to claim 1, wherein a failure of said high-pressure fuel system is determined according to a number of consecutive engine startups of said internal-combustion engine which result in an engine stall of said internal-combustion engine.

4. The cylinder injection type fuel control apparatus according to claim 1, wherein a failure of said high-pressure fuel system is detected by a fuel pressure sensor provided in said high-pressure fuel system, wherein said fuel pressure sensor outputs a signal corresponding to the failure of said high pressure fuel system.

5. The cylinder injection type fuel control apparatus according to claim 2, wherein a failure of said high-pressure fuel system is determined according to a number of consecutive engine startups of said internal-combustion engine which result in an engine stall of said internal-combustion engine.

6. The cylinder injection type fuel control apparatus according to claim 2, wherein a failure of said high-pressure fuel system is detected by a fuel pressure sensor provided in said high-pressure fuel system wherein said fuel pressure sensor outputs a signal corresponding to the failure of said high-pressure fuel system.

* * * * *